US012654922B2

(12) United States Patent
Au

(10) Patent No.: US 12,654,922 B2
(45) Date of Patent: Jun. 16, 2026

(54) FULLY PAPER-MADE HOOK-SHAPED DISPLAY CARD

(71) Applicant: Nationalpak Limited, Hong Kong (HK)

(72) Inventor: Ka Fai Kinsen Au, Hong Kong (HK)

(73) Assignee: Nationalpak Limited, Hong Kong (HK)

( * ) Notice: Subject to any disclaimer, the term of this patent is extended or adjusted under 35 U.S.C. 154(b) by 0 days.

(21) Appl. No.: 18/820,409

(22) Filed: Aug. 30, 2024

(65) Prior Publication Data

US 2025/0074679 A1 Mar. 6, 2025

(30) Foreign Application Priority Data

Aug. 31, 2023 (CN) ..... 202322371240.X

(51) Int. Cl.
*A45C 11/04* (2006.01)
*B65D 73/00* (2006.01)

(52) U.S. Cl.
CPC ..... *B65D 73/0021* (2013.01)

(58) Field of Classification Search
CPC ..... B65D 73/0021; A45C 11/04
USPC .... 206/5, 6.1, 338, 340, 348, 495, 562, 566, 206/806; 211/85.2
See application file for complete search history.

(56) References Cited

U.S. PATENT DOCUMENTS

| | | | | |
|---|---|---|---|---|
| 3,039,372 | A * | 6/1962 | Leon | B31F 1/08 493/396 |
| 5,709,297 | A * | 1/1998 | Brandriff | B65D 73/00 206/813 |
| 9,427,056 | B2 * | 8/2016 | Nietvelt | A45C 11/00 |
| 11,447,323 | B2 * | 9/2022 | Kataoka | B65D 85/672 |
| 2013/0098781 | A1 * | 4/2013 | Galan | B65D 73/0021 53/473 |
| 2018/0072451 | A1 * | 3/2018 | Niemuth | B31B 50/20 |

* cited by examiner

*Primary Examiner* — Luan K Bui

(57) ABSTRACT

The present application provides a fully paper-made hook-shaped display card, said display card is made entirely of paper material, including a cardboard on the front and a plastic-free paper on the bottom; two V-grooves are opened near a top edge of the plastic-free paper, and a hook for hanging on a display rack is formed by the display card as a whole bent along the two V-grooves towards one side of the plastic-free paper in two folds. The display card of the present application can be recycled and is environmentally friendly. It also addresses the issue of insufficient strength when using cardboard to form the hook, which can result in inadequate hooking onto display racks or even breakage; additionally, it enhances the durability of the perforation marks used for attaching jewelry.

6 Claims, 1 Drawing Sheet

FULLY PAPER-MADE HOOK-SHAPED DISPLAY CARD

CROSS REFERENCE TO RELATED APPLICATIONS

The present application claims the benefit of Chinese Patent Application No. 202322371240.X filed on Aug. 31, 2023, the contents of which are incorporated herein by reference in their entirety.

TECHNICAL FIELD

The present application relates to the field of article display, especially relates to fully paper-made hook-shaped display card.

BACKGROUND

Earrings, pendants, and other small accessories are generally displayed using hook-shaped display cards. The surface of the hook-shaped display card is made of paper, while the bottom is glued with a film and formed through hot pressing. As a result, the entire hook-shaped display card is made of mixed materials and cannot be recycled after use, which is not environmentally friendly.

SUMMARY

The technical problem addressed by the present application is to provide a fully paper-made hook-shaped display card that addresses the above-mentioned deficiencies in the existing technology.

The technical solutions adopted by the present application to solve its technical problems are: providing a fully paper-made hook-shaped display card, said display card is made entirely of paper material, including a cardboard on the front and a plastic-free paper on the bottom; two V-grooves are opened near a top edge of the plastic-free paper, and a hook for hanging on a display rack is formed by the display card as a whole bent along the two V-grooves towards one side of the plastic-free paper in two folds.

Further, in the fully paper-made hook-shaped display card of the present application, the cardboard and the plastic-free paper are both rectangular, the two V-grooves are parallel to the top edge of the plastic-free paper and spaced apart in a direction perpendicular to the top edge of the plastic-free paper; each V-groove extends from the first side edge of the plastic-free paper to the opposite second side edge.

Further, in the fully paper-made hook-shaped display card of the present application, a distance between the two V-grooves is consistent with a distance from the top edge of the plastic-free paper to the uppermost V-groove.

Further, in the fully paper-made hook-shaped display card of the present application, both folds are bent at a 90-degree angle, and the hook is U-shaped.

Further, in the fully paper-made hook-shaped display card of the present application, adhesive is applied along the V-grooves.

Further, in the fully paper-made hook-shaped display card of the present application, two perforation marks are additionally located below the two V-grooves on the display card, with both perforation marks symmetrically positioned about the vertical centerline of the top edge of the display card.

Further, in the fully paper-made hook-shaped display card of the present application, the perforation mark is U-shaped.

Further, in the fully paper-made hook-shaped display card of the present application, the perforation marks are located between the vertical centerlines of the top and bottom edges of the display card and the V-grooves.

Further, in the fully paper-made hook-shaped display card of the present application, a thickness of the cardboard is greater than that of the plastic-free paper.

Further, in the fully paper-made hook-shaped display card of the present application, the cardboard is also covered with surface paper.

The fully paper-made hook-shaped display card of the present application has the following beneficial effects: the display card of the present application is made entirely of paper materials, which can be recycled and is environmentally friendly; the display card includes cardboard on the front and plastic-free paper on the bottom; two V-grooves are opened near a top edge of the plastic-free paper to create a strong hook when folded; this design addresses the issue of insufficient strength when using cardboard to form the hook, which can result in inadequate hooking onto display racks or even breakage; additionally, it enhances the durability of the perforation marks used for attaching jewelry.

BRIEF DESCRIPTION OF THE DRAWINGS

To provide a clearer explanation of the embodiments of the application or the technical solutions in the prior art, a brief introduction will be given below on the drawings needed in the description of the embodiments or the prior art. It is evident that the drawings described below are only examples of the present application. For those skilled in the art, without exerting creative effort, other drawings can be obtained based on the provided drawings.

DETAILED DESCRIPTION OF THE PREFERRED EMBODIMENT

For a better understanding of the present application, a more comprehensive description of the application will be provided with reference to the accompanying drawings. The drawings present typical embodiments of the present application. However, the present application can be implemented in many different forms, and is not limited to the embodiments described in this document. On the contrary, the purpose of providing these embodiments is to ensure a thorough and comprehensive disclosure of the present application. It should be understood that the embodiments of the present application and the specific features therein are a detailed explanation of the technical solutions proposed in this application, rather than a limitation of the technical solutions. Where there is no conflict, the technical features of the embodiments and examples of the present application can be combined with each other.

Figure 1:
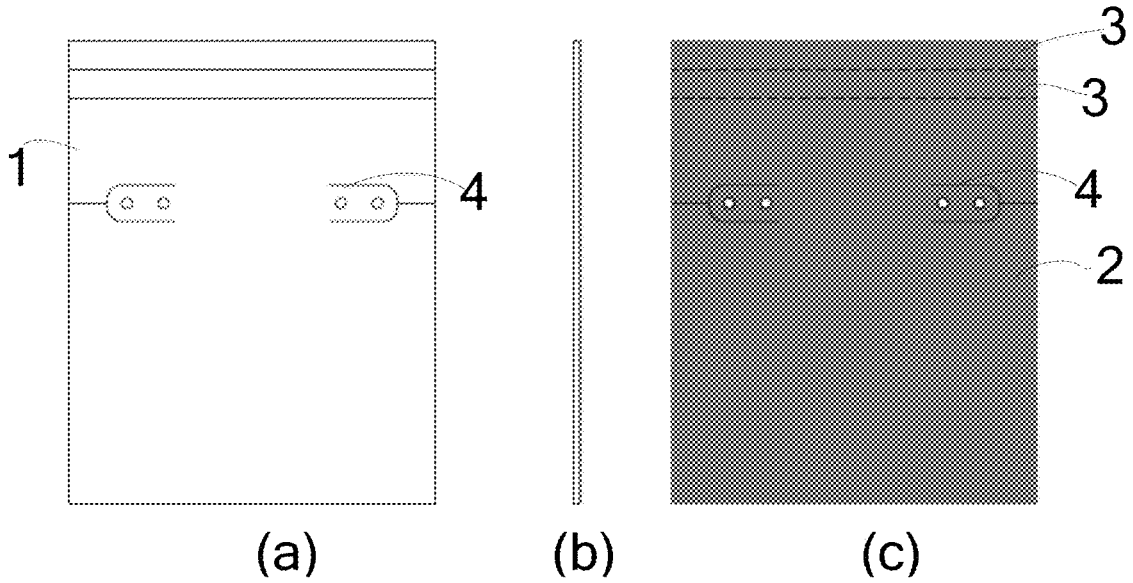
FIG. 1 is a schematic diagram of the unfolded fully paper-made hook-shaped display card of the present application before folding.
Figure 2:
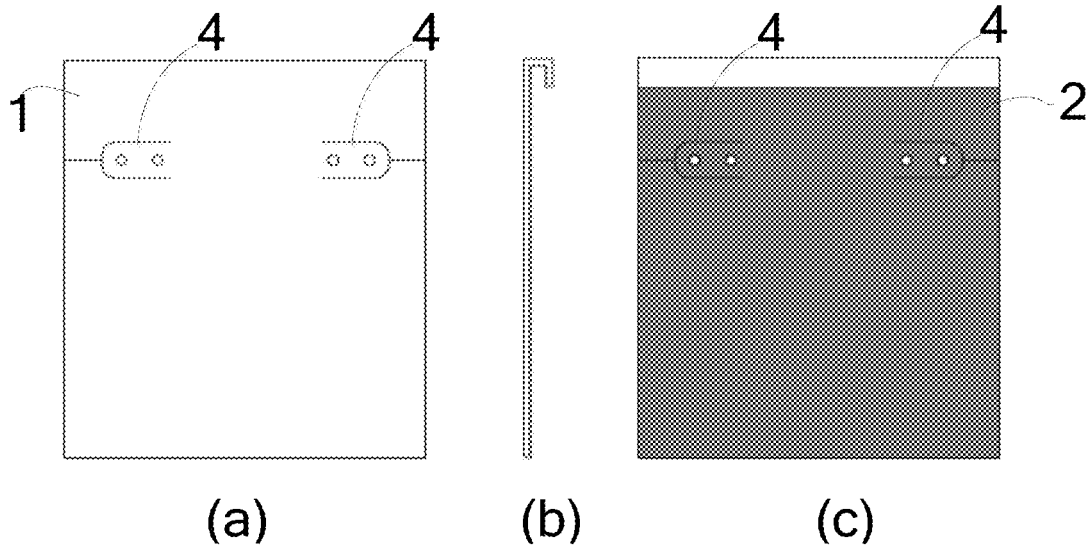
FIG. 2 is a structural schematic diagram of the fully paper-made hook-shaped display card of the present application.

Referring to FIGS. 1-2, FIG. 1 is a schematic diagram of the unfolded fully paper-made hook-shaped display card of the present application, and FIG. 2 is a structural schematic diagram of the fully paper-made hook-shaped display card of the present application. In FIGS. 1 and 2, a, b, and c respectively represent the front, side, and bottom views. The fully paper-made hook-shaped display card of this embodiment can be hung on a display rack for the display of various jewelry such as earrings, pendants, and necklaces. The display card of this embodiment is made entirely of paper material, which can be recycled and is environmentally friendly.

In this embodiment, the display card includes a cardboard 1 located on the front and a super-tough plastic-free paper 2 located at the bottom, with the cardboard 1 generally being decorated with surface paper. The shapes and dimensions of the cardboard 1 and the plastic-free paper 2 are the same, both being rectangles with a width of 63 mm and a height of 80 mm. The cardboard 1 and plastic-free paper 2 are fixed by adhesive.

The plastic-free paper 2 has two V-grooves 3 opened at the top edge position, with both V-grooves 3 being parallel to the top edge of the plastic-free paper 2 and spaced apart in the direction perpendicular to the top edge of the plastic-free paper 2. The entire display card is bent along the two V-grooves 3 towards one side of the plastic-free paper 2 to form a hook for hanging on the display rack. The two bends are both 90 degrees, so the hook is U-shaped.

Specifically, each V-groove 3 extends from one side edge of the plastic-free paper 2 to the opposite side edge, horizontally from the left side to the right side, spanning the entire width of the plastic-free paper 2. The distance between the upper and lower V-grooves 3 is consistent with the distance from the top V-groove 3 to the top edge of the plastic-free paper 2, both being 5 mm.

In this embodiment, before folding into hook positions along the V-grooves 3, adhesive can be applied. Generally, after opening V-grooves on copperplate paper/cardboard/paperboard, the surface paper is prone to cracking and may detach under stress. In this embodiment, a super-tough plastic-free paper 2 is added at the bottom layer, which has high toughness, is resistant to tearing, and durable, effectively preventing the paper from cracking after V-grooving. Specifically, the thickness of the cardboard 1 is greater than that of the plastic-free paper 2; in this embodiment, plastic-free paper 2 is approximately 0.09 mm thick, with an additional non-plastic white cardboard 1 of about 1 mm thick attached to it, providing sufficient toughness and support for the hook positions when combined.

The display card also features left and right perforation marks 4 beneath the two V-grooves 3, positioned symmetrically about the midpoint between the top and bottom edges of the display card and between the V-grooves 3. The left and right perforation marks 4 are symmetrically positioned about the vertical midpoint of the top edge of the display card. These marks are cutouts from the left and right sides of the display card, forming two U-shaped hooks. Each U-shaped hook is symmetrical vertically and oriented parallel to the bottom V-groove 3, spaced 18 mm apart. The nearest distance from each U-shaped hook to the closest side edge of the display card is 6.5 mm. Each U-shaped hook has a length (horizontal direction) of 12 mm and a width (vertical direction) of 6.5 mm. The addition of the super-tough plastic-free paper 2 on the bottom surface in this embodiment also enhances the durability of these perforation marks 4 used for hanging jewelry.

Furthermore, the shape of the entire display card in this embodiment is not limited to a rectangle; it can also be circular, elliptical, or irregular, all of which are simple variations within the protective scope of this utility model. Similarly, the dimensions of specific structural features in the display card are illustrative examples in this embodiment and do not limit the scope of the application.

In summary, the fully paper-made hook-shaped display card of the present application has the following beneficial effects: the display card of the present application is made entirely of paper materials, which can be recycled and is environmentally friendly; the display card includes cardboard on the front and plastic-free paper on the bottom; two V-grooves are opened near a top edge of the plastic-free paper to create a strong hook when folded; this design addresses the issue of insufficient strength when using cardboard to form the hook, which can result in inadequate hooking onto display racks or even breakage; additionally, it enhances the durability of the perforation marks used for attaching jewelry.

The terms "vertical," "horizontal," "left," "right," and similar expressions used in this article are for illustrative purposes only. Unless otherwise defined, all technical and scientific terms used in this application have the same meaning as understood by those skilled in the art in the technical field to which the present application belongs. The terms used in the specification of the present application in this document are only for the purpose of describing specific embodiments and not intended to limit the application.

The terms containing ordinals such as "first," "second," etc., used in this specification can be used to describe various constituent elements, but these elements are not limited by these terms. The use of these terms is solely to distinguish one constituent element from another. For example, without departing from the scope of the present application, the first constituent element can be named the second constituent element, and similarly, the second constituent element can also be named the first constituent element.

The above description, combined with the drawings, describes embodiments of the present application, but the application is not limited to the specific embodiments mentioned above. These specific embodiments are illustrative and not limiting. Those skilled in the art, guided by the present application, can make many other forms within the scope of the purpose and claims protected by the application.

The invention claimed is:

1. A fully paper-made hook-shaped display card, characterized in that said display card is made entirely of paper material, including a cardboard (1) on the front and a plastic-free paper (2) on the bottom; two V-grooves (3) are opened near a top edge of the plastic-free paper (2), and a hook for hanging on a display rack is formed by the display card as a whole bent along the two V-grooves (3) towards one side of the plastic-free paper (2) in two folds;

the cardboard (1) and the plastic-free paper (2) are both rectangular, the two V-grooves (3) are parallel to the top edge of the plastic-free paper (2) and spaced apart in a direction perpendicular to the top edge of the plastic-free paper (2); each V-groove (3) extends from the first side edge of the plastic-free paper (2) to the opposite second side edge; a distance between the two V-grooves (3) is consistent with a distance from the top edge of the plastic-free paper (2) to the uppermost V-groove (3); both folds are bent at a 90-degree angle, and the hook is U-shaped; a thickness of the cardboard (1) is greater than that of the plastic-free paper (2).

2. The fully paper-made hook-shaped display card according to claim 1, wherein, adhesive is applied along the V-grooves (3).

3. The fully paper-made hook-shaped display card according to claim 1, wherein, two perforation marks (4) are additionally located below the two V-grooves (3) on the display card, with both perforation marks (4) symmetrically positioned about the vertical centerline of the top edge of the display card.

4. The fully paper-made hook-shaped display card according to claim 3, wherein, the perforation mark (4) is U-shaped.

5. The fully paper-made hook-shaped display card according to claim 3, wherein, the perforation marks (4) are located between the vertical centerlines of the top and bottom edges of the display card and the V-grooves (3).

6. The fully paper-made hook-shaped display card according to claim 1, wherein, the cardboard (1) is also covered with surface paper.

* * * * *